US008518129B2

(12) United States Patent
Felix-Moore et al.

(10) Patent No.: US 8,518,129 B2
(45) **Date of Patent: *Aug. 27, 2013**

(54) GASOLINE COMPOSITIONS

(75) Inventors: Allison Felix-Moore, Chester (GB); Jean-Paul Lange, Amsterdam (NL); Richard John Price, Chester (GB); Johanne Smith, Chester (GB)

(73) Assignee: Shell Oil Company, Houston, TX (US)

( * ) Notice: Subject to any disclaimer, the term of this patent is extended or adjusted under 35 U.S.C. 154(b) by 254 days.

This patent is subject to a terminal disclaimer.

(21) Appl. No.: 12/787,273

(22) Filed: May 25, 2010

(65) Prior Publication Data

US 2011/0035992 A1 Feb. 17, 2011

(30) Foreign Application Priority Data

May 25, 2009 (EP) ..... 09160986

(51) Int. Cl.
*C10L 1/18* (2006.01)

(52) U.S. Cl.
USPC ..... 44/352; 44/388; 44/448; 44/451; 44/452

(58) Field of Classification Search
USPC ..... 44/352, 388, 448, 451
See application file for complete search history.

(56) References Cited

U.S. PATENT DOCUMENTS

| | | | | |
|---|---|---|---|---|
| 3,282,662 | A * | 11/1966 | Henderson | 44/388 |
| 3,563,715 | A | 2/1971 | Richardson | 44/66 |
| 5,606,102 | A | 2/1997 | Fauconet et al. | 560/205 |
| 5,697,987 | A | 12/1997 | Paul | 44/352 |
| 5,855,629 | A | 1/1999 | Grundy et al. | 44/400 |
| 6,156,082 | A | 12/2000 | MacMillan et al. | 44/398 |
| 6,923,839 | B2 * | 8/2005 | Stickney et al. | 44/388 |
| 2001/0024966 | A1 | 9/2001 | Miller et al. | 455/569 |
| 2001/0034966 | A1 | 11/2001 | Golubkov et al. | 44/329 |
| 2002/0026744 | A1 | 3/2002 | Golubkov et al. | 44/436 |

FOREIGN PATENT DOCUMENTS

| | | |
|---|---|---|
| EP | 499731 | 8/1992 |
| EP | 780460 | 6/1997 |
| EP | 1731589 | 12/2006 |
| FR | 2757539 | 6/1998 |
| GB | 1174148 | 8/1967 |
| JP | 5821630 | 2/1983 |
| JP | 02164848 | 6/1990 |
| WO | WO9404636 | 3/1994 |

OTHER PUBLICATIONS

Written Opinion, PCT International Searching Authority, International Application No. PCT/EP2010/057133, May 25, 2010(PCT Rule 43).

European Search Report, Application No. EP 2010/057133, Aug. 17, 2010.

* cited by examiner

*Primary Examiner* — Cephia D Toomer

(57) ABSTRACT

Gasoline compositions are provided comprising component A, an alkyl alkenoate compound, or a mixture of alkyl alkenoate compounds, selected from compounds of formula I:

(I)

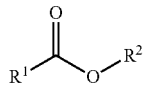

wherein $R^1$ is a linear alkenyl group containing 3 to 5 carbon atoms, optionally substituted by a methyl group, and $R^2$ is a linear or branched alkyl group containing 1 to 6 carbon atoms, with the proviso that component A has a boiling point or boiling point range within the temperature range of from 90 to 200° C., and at least one additional selected component.

22 Claims, No Drawings

GASOLINE COMPOSITIONS

FIELD OF THE INVENTION

The present invention relates to an oxygenate composition suitable for use in gasoline.

BACKGROUND OF THE INVENTION

Esters are known components for use in fragrance and flavouring applications. Esters of unsaturated acids have also found application as general chemicals, e.g. as solvents.

Alkanols can be used in the preparation of esters and in other chemical processes. The abstracts of JP 02 164848 A and JP 58021630 A disclose respectively the preparation of methacrylic esters by use of a blend of methyl methacrylate with a mixture of ethyl and butyl alcohols, and the purification of raw ethanol/butanol mixtures by the addition of ethyl acrylate. EP 499731 A1 documents the addition of alkanols to alkyl acrylate to form 3-alkyl propanoates. GB 1,174,148 relates to the production of esters of unsaturated acids, particularly acrylic and methacrylic esters via transesterification with alcohols and amino-alcohols. U.S. Pat. No. 5,606,102 concerns the purification of butyl acrylate from an azeotropic mixture of the acrylate and the esterifying alcohol, butanol.

Unsaturated esters have previously been used in diesel fuel applications; in particular, when the unsaturated esters are in the form of, or contained within, fatty acid methyl ester (FAME) compositions.

Low carbon number acrylates and methacrylates, for example methyl, ethyl and tert-butyl acrylates and methacrylates, are known to be skin sensitisers, where even a small amount, eg 0.1 wt %, can trigger a problem. Therefore it is undesirable to use such compounds as a component of a fuel composition.

EP 1731589 A2 discloses palm-based biodiesel formulations with enhanced cold flow properties. Alkyl esters of $C_6$-$C_{18}$ saturated or unsaturated fatty acids are disclosed as one possible component of the biodiesel.

US 2002/0026744 A1 discloses motor fuel compositions comprising an oxygen-containing component and optionally a hydrocarbon component. The oxygen-containing component disclosed therein comprises a mixture of organic compounds having oxygen-containing functional groups. The oxygen-containing functional groups disclosed therein include alcohols, ethers, aldehydes, ketones, esters, inorganic acid esters, acetals, epoxides and peroxides. The motor fuel compositions of US 2002/0026744 A1 were used as a fuel for various diesel, jet, gas-turbine and turbojet engines.

Esters as a general class of compounds alongside ethers, alcohols, ketones and other oxygenated components, are also proposed as additives for fuels in US 2001/0024966 A1, to improve vapour pressure properties. US 2001/0024966 A1 however does not specifically disclose or exemplify the use of low carbon number alkyl alkenoate compounds; the preferred use is of $C_5$-$C_8$ alkyl esters of saturated carboxylic acids.

FR 2757539 A1 discloses a fuel and a process for manufacturing a fuel from vegetable matter. The process disclosed involves the production of esters from vegetable matter, and the inclusion of them in a fuel.

Due to environmental concerns, there is a growing demand for the use of bio-components, i.e. components derived from a biological source, in gasoline.

Ethanol is a well known bio-component currently used in gasoline, however, it has been observed that the addition of ethanol to base gasoline has the effect of increasing the E70 and E100 of the formulated gasoline relative to the base gasoline. Therefore, in order to include significant quantities of ethanol in gasoline, the base gasoline to which it is added has to be specially formulated in order for the formulated gasoline to meet gasoline specifications around the world.

SUMMARY OF THE INVENTION

In one embodiment, the present invention provides a composition comprising component A and at least one component selected from components B, C, D and E, wherein:

component A is an alkyl alkenoate compound, or a mixture of alkyl alkenoate compounds, having formula I:

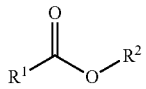

(I)

wherein $R^1$ is a linear alkenyl group containing 3 to 5 carbon atoms, optionally substituted by a methyl group, and $R^2$ is a linear or branched alkyl group containing 1 to 6 carbon atoms, with the proviso that component A has a boiling point or boiling point range within the temperature range of from 90 to 200° C.;

component B is ethanol;

component C is a compound of formula II or formula III:

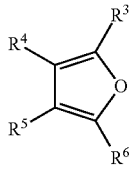

(II)

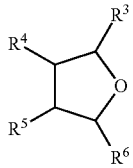

(III)

wherein the $R^3$, $R^4$, $R^5$ and $R^6$ groups are independently selected from hydrogen and $C_{1-6}$ hydrocarbyl groups, with the proviso that component C has a boiling point or boiling point range of at most 110° C.;

component D is butanol; and component E is an ether of the general formula IV.

$$R^7—O—C(Me)_3 \quad \text{(IV)}$$

wherein $R^7$ is selected from methyl, ethyl or mixtures thereof.

In another embodiment, the present invention provides a composition as described herein, wherein said composition comprises component A and at least one component selected from categories (a) and (b) below:

(a) component B, and (b) one component selected from components C, D and E.

In another embodiment, the present invention provides a composition comprising component A and at least one component selected from categories (a) and (b) above, wherein the concentration of the components is calculated using the following equation (equation I):

$$\sum_{n=1}^{n=3} v_{fn} E70_n - E70_{base} = E100_{base} - \sum_{n=1}^{n=3} v_{fn} E100_n \quad \text{(equation I)}$$

wherein:

n=1 is component B, n=2 is component A, n=3 is any one of components C, D or E, $v_{fn}$ is the volume fraction of the component n=1, 2 or 3 in the composition comprising component A and at least one component selected from components B, C, D and E, $E70_n$ is the blending E70 value of the component represented by n, $E100_n$ is the blending E100 value of the component represented by n, $E70_{base}$ is in the range of from 5 to 65% vol., and $E100_{base}$ is in the range of from 30 to 85% vol.

In yet another embodiment, the present invention further provides a gasoline composition comprising a base gasoline and a composition as described herein.

DETAILED DESCRIPTION OF THE INVENTION

It has now been found that blends of certain oxygenates can be prepared that can be blended with base gasoline to provide a gasoline composition without significantly altering the E70 and E100 value of the base gasoline.

The oxygenates composition of the present invention comprises component A and at least one component selected from components B, C, D and E.

The composition of the present invention preferably comprises component A and at least one component selected from categories (a) and (b) below:

(a) component B, and (b) one component selected from components C, D and E.

i.e. the composition of the present invention preferably comprises any of the following mixtures of components A, B, C, D and E:

Component A and component B;

Component A and component C;

Component A and component D;

Component A and component E;

Component A, component B and component C;

Component A, component B and component D; and

Component A, component B and component E.

Component A is an alkyl alkenoate compound, or mixture of alkyl alkenoate compounds, having formula I:

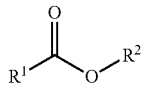

(I)

wherein $R^1$ is a linear alkenyl group containing 3 to 5 carbon atoms, optionally substituted by a methyl group, and $R^2$ is a linear or branched alkyl group containing 1 to 6 carbon atoms, with the proviso that component A has a boiling point or boiling point range within the temperature range of from 90 to 200° C.

Preferably, the $R^1$ group is an alkenyl group which contains 3 or 4 carbon atoms, and especially 4 carbon atoms. A particularly preferred $R^1$ group is an unsubstituted linear alkenyl group containing 4 carbon atoms. Typically, the carbon chain of the $R^1$ group will only contain a single point of unsaturation (mono-olefinic).

Preferably, the $R^2$ group is an alkyl group which contains from 1 to 5 carbon atoms, more preferably from 1 to 4 carbon atoms, and especially from 2 to 4 carbon atoms. A particularly preferred $R^2$ group is a linear alkyl group containing from 2 to 4 carbon atoms. Examples of particularly preferred $R^2$ groups include methyl, ethyl, propyl, iso-propyl, butyl, iso-butyl, and tert-butyl groups. An especially preferred $R^2$ group is ethyl.

Component A has a boiling point, or boiling point range having an upper limit of at most 200° C. However, preferably component A has a boiling point, or boiling point range, having an upper limit of at most 190° C., at most 180° C., at most 170° C., or at most 160° C. The boiling point, or boiling point range, of component A also has a lower limit of at least 90° C. However, preferably component A has a boiling point, or boiling point range, having a lower limit of at least 100° C., at least 110° C., at least 120° C., or at least 130° C.

Typically, the boiling point, or boiling point range, of component A is within a range having a lower limit selected from any one of 90° C., 100° C., 110° C., 120° C., and 130° C., and an upper limit selected from any one of 200° C., 190° C., 180° C., 170° C., and 160° C.

Examples of suitable compounds according to formula I include methyl butenoate, ethyl butenoate, propyl butenoate, butyl butenoate, methyl pentenoate, ethyl pentenoate, propyl pentenoate, butyl pentenoate, methyl hexenoate, ethyl hexenoate, propyl hexenoate, their methyl-substituted analogues, and mixtures thereof. The isomers, whether they are stereoscopic isomers or structural isomers, of each of the aforementioned compounds are also explicitly covered by the present invention.

Most preferably component A comprises or is ethyl pentenoate, which may be in the form of any single isomer, such as ethyl 2-pentenoate, ethyl 3-pentenoate or ethyl 4-pentenoate, or a mixture of any two or more isomers.

When in mixed isomer form, the primary isomer present is most suitably the trans-isomer of ethyl 3-pentenoate, which may suitably be present in an amount of from 45 to 50 wt % of the total amount of isomers present. The cis-isomer of ethyl 3-pentenoate and ethyl 4-pentenoate may suitably be present each in an amount in the range of from 20 to 25 wt % of the total of mixed isomers. Ethyl 2-pentenoate may also suitably be present for example in an amount in the range of from 5 to 10 wt % of the total isomer mixture. Naturally the total percentage of ethyl pentenoate, in whatever isomeric form present in the isomer mixture, cannot exceed 100 wt %. It is possible, depending on the origin of the isomeric mixture, for minor amounts, e.g. less than 2 wt %, of other compounds, for example diethyl ether and/or unreacted starting materials, to be present in the isomer mixture. Such components may be present for example in an amount in the range of from 0.1 to 1.5 wt % of the total mixture.

Component B is ethanol.

Component C is a compound or mixture of compounds having formula II or formula III:

(II)

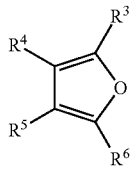

(III)

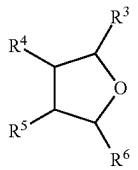

wherein the $R^3$, $R^4$, $R^5$ and $R^6$ groups are independently selected from hydrogen and $C_{1-6}$ hydrocarbyl groups, with the proviso that component C has a boiling point or boiling point range of at most 110° C.

Preferably, one or two of the $R^3$, $R^4$, $R^5$ and $R^6$ groups are independently selected from $C_{1-6}$ hydrocarbyl groups, with the remaining $R^3$, $R^4$, $R^5$ and $R^6$ groups being hydrogen. More preferably, the $R^4$ and $R^5$ groups are hydrogen and the $R^3$ and $R^6$ groups are independently selected from hydrogen and $C_{1-6}$ hydrocarbyl groups, with at least one of the $R^3$ and $R^6$ groups being a $C_{1-6}$ hydrocarbyl group.

Preferably, the $C_{1-6}$ hydrocarbyl groups are $C_{1-6}$ alkyl groups, more preferably methyl, ethyl and propyl groups.

The boiling point or boiling point range of component C is preferably at most 105° C., more preferably at most 100° C. Typically, the boiling point or boiling point range of component C is in the range of from 40 to 110° C., more typically in the temperature range of from 50 to 105° C., most typically in the temperature range of from 60 to 100° C.

Examples of suitable compounds according to formula II include 2-methyl furan, 3-methyl furan, 2-ethyl furan, 3-ethyl furan, 2,5-dimethyl furan, 2,5-diethyl furan and 2-methyl-5-ethyl furan, and mixtures thereof. Examples of suitable compounds according to formula III include 2-methyl tetrahydrofuran, 3-methyl tetrahydrofuran, 2-ethyl tetrahydrofuran, 3-ethyl tetrahydrofuran, 2,5-dimethyl tetrahydrofuran, 2,5-diethyl tetrahydrofuran and 2-methyl-5-ethyl tetrahydrofuran, and mixtures thereof.

Most preferably component C is selected from 2-methyl furan, 2,5-dimethyl furan and mixtures thereof.

Component D is butanol.

Component E is an ether of the general formula IV.

$$R^7—O—C(Me)_3 \quad \text{(IV)}$$

wherein $R^7$ is selected from methyl, ethyl or mixtures thereof.

The composition of the present invention is suitable for blending with a base gasoline to form a gasoline composition.

Components A, B, C and D can be derived from a biological source using methods known in the art, therefore compositions according to the present invention may be partially or entirely derived from a biological source material and therefore be included in a gasoline composition as a biofuel component. Preferably, at least one of components A to D is derived from a biological source material.

Advantageously, by varying the relative concentrations of the at least two different components in the composition of the present invention, it allows the formation of a gasoline component that has a reduced impact on the Dry Vapour Pressure Equivalent (DVPE) (EN 13016-1), E70 (% vol. evaporated at 70° C., as determined by EN ISO 3405) and E100 (% vol. evaporated at 100° C., as determined by EN ISO 3405) of the base gasoline to which it is to be blended, compared to the blending of a concentration equal to the concentration of the composition of the present invention of any of the individual components.

It has been found that for a given E70 and E100 of the base gasoline, a composition according to the present invention may be blended that will not significantly alter the E70 and E100 values in the formed gasoline composition. By the term "not significantly alter the E70 and E100 values" it is meant that both the E70 value and the E100 value of the formulated gasoline composition is maintained within 25%, preferably within 20%, more preferably within 15%, of both the E70 value and the E100 value of the base gasoline, and the value of E70+E100 will be maintained within 15%, preferably within 10%, more preferably within 5% of the value of E70+E100 of the base gasoline. In order to achieve this result, for a given E70 and E100 of a base gasoline ($E70_{base}$ and $E100_{base}$ respectively), the most preferred concentrations of the two or three components of the composition of the present invention can be calculated using the following equation (equation I):

$$\sum_{n=1}^{n=3} v_{fn} E70_n - E70_{base} = E100_{base} - \sum_{n=1}^{n=3} v_{fn} E100_n \quad \text{(equation I)}$$

wherein:

n=1 is component B, n=2 is component A, n=3 is any one of components C, D or E, $v_{fn}$ is the volume fraction of the component n=1, 2 or 3 in a the composition comprising component A and at least one component selected from components B, C, D and E, $E70_n$ is the blending E70 value of the component represented by n, $E100_n$ is the blending E100 value of the component represented by n, $E70_{base}$ is the E70 value of base gasoline, and $E100_{base}$ is the E100 value of base gasoline.

The blending $E70_n$ and $E100_n$ values for components A, B, C, D and E are average values determined from data collected on base fuels containing the single oxygenate component (n=A, B, C, D or E) added across a range of blend ratios. The $E70_n$ and $E100_n$ values are determined according to equations II and III below:

$$E70_n = \frac{E70_{blend} - E70_{base}(1 - v_{fn})}{v_{fn}} \quad \text{(equation II)}$$

$$E100_n = \frac{E100_{blend} - E100_{base}(1 - v_{fn})}{v_{fn}} \quad \text{(equation III)}$$

wherein:

n is component A, B, C, D or E $v_{fn}$ is the volume fraction of the component A, B, C, D or E when combined with a base gasoline $E70_{base}$ is the E70 value of base gasoline $E100_{base}$ is the E100 value of base gasoline.

$E70_{blend}$ is the E70 value of the base gasoline combined with component A, B, C, D or E, and $E100_{blend}$ is the E100 value of the base gasoline combined with component A, B, C, D or E.

The $E70_{base}$ value is preferably in the range of from 5 to 65% vol., more preferably in the range of from 10 to 60% vol., and most preferably in the range of from 15 to 55% vol.

The $E100_{base}$ value is preferably in the range of from 30 to 85% vol., more preferably in the range of from 35 to 80% vol., and most preferably in the range of from 40 to 75% vol.

Currently, the EN228 gasoline specification specifies that the E70 value is in the range of from 20 to 50% vol., specifically for summer gasoline the E70 value is in the range of from 20 to 48% vol. and for winter gasoline E70 value is in the range of from 22 to 50% vol., and the E100 value is in the range of from 46 to 71% vol. Therefore, the $E70_{base}$ value and the $E100_{base}$ value are conveniently in the range of from 20 to 50% vol. and from 46 to 71% vol., respectively.

Thus, the composition of the present invention may be blended with a base gasoline that complies with current gasoline specifications (e.g. EN228) in relation to DVPE, E70 and E100, to form a gasoline composition which still complies with same gasoline specification relating to DVPE, E70 and E100.

Usefully, because at least one of components A to E can be derived from a biological source material and the fact that compositions according to the present invention may be blended with a base gasoline without significantly altering the E70 and E100 values, the composition of the present invention can be used in order to maximize the bio-energy content of a gasoline composition.

However, because a base gasoline may be blended with compositions of the present invention having relative concentrations of components A to E that are not defined by equation I above in order to form a gasoline composition wherein the E70 value and/or an E100 value is different from the E70 value and/or the E100 value of the base gasoline; and because the change in the E70 and the E100 values of a base gasoline caused by the blending a composition according to the present invention with said base gasoline is proportional to the concentration of the composition according to the present invention in the blended gasoline composition, with higher concentrations of the composition according to the present invention causing a greater change in the E70 and/or E100 values of the base gasoline. An alternative preferred embodiment of the present invention is also provided which specifically encompasses compositions of component A and at least one component selected from components B, C, D and E, having relative concentrations defined as follows.

If the composition of the present invention comprises component A and component B only, then the composition preferably comprises at least 50% vol. of component A and at most 50% vol. of component B. More preferably, if the composition of the present invention comprises component A and component B only, then the composition preferably comprises at least 58% vol. of component A and at most 42% vol. of component B.

If the composition of the present invention comprises component A and component C only, then the composition preferably comprises at most 70% vol. of component A and at least 30% vol. of component C, such that the total amount of component A and component C is 100% vol. More preferably, if the composition of the present invention comprises component A and component C only, then the composition preferably comprises at most 49% vol. of component A and at least 51% vol. of component C, such that the total amount of component A and component C is 100% vol.

If the composition of the present invention comprises component A and component D only, then the composition preferably comprises at most 50% vol. of component A and at least 50% vol. of component D, such that the total amount of component A and component D is 100% vol. More preferably, if the composition of the present invention comprises component A and component D only, then the composition preferably comprises at most 15% vol. of component A and at least 85% vol. of component D, such that the total amount of component A and component D is 100% vol.

If the composition of the present invention comprises component A and component E only, then the composition preferably comprises at most 50% vol. of component A and at least 50% vol. of component E, such that the total amount of component A and component E is 100% vol. More preferably, if the composition of the present invention comprises component A and component E only, then the composition preferably comprises at most 41% vol. of component A and at least 59% vol. of component E, such that the total amount of component A and component E is 100% vol.

If the composition of the present invention comprises components A, B and C, then the concentration of the composition preferably comprises:

From 23 to 72% vol. of component A;

From 0.1 to 42% vol. of component B;

From 0.1 to 77% vol. of component C; and

If the composition of the present invention comprises components A, B and D, then the concentration of the composition preferably comprises:

From 0.1 to 72% vol. of component A;

From 0.1 to 42% vol. of component B;

From 0.1 to 99.9% vol. of component D; and

If the composition of the present invention comprises components A, B and E, then the concentration of the composition preferably comprises:

From 10 to 72% vol. of component A;

From 0.1 to 42% vol. of component B;

From 0.1 to 90% vol. of component E; and

The compositions of the present invention typically have high RON (Research Octane Number) and MON (Motor Octane Number) values, and therefore may be also be used to increase the RON and/or MON of a base gasoline.

The present invention also provides a gasoline composition comprising:

(i) base gasoline; and (ii) a composition comprising component A and at least one component selected from components B, C, D and E, as described above.

The gasoline composition according to the present invention may be prepared by blending the base gasoline with component A and at least one component selected from components B, C, D and E. The order in which the base gasoline and components A to E are combined is not critical. Therefore, the gasoline composition of the present invention can also be described as comprising:

(i) base gasoline; and (ii) component A and at least one component selected from components B, C, D and E, as described above.

The preferred relative concentrations of components A to E in the gasoline composition are as described above and are calculated on the basis of a composition comprising component A and at least one component selected from components B, C, D and E, in the absence of the base gasoline, whether or not such a composition is prepared prior to combining components A to E with the base gasoline.

The concentration, based on the overall gasoline composition, of the composition comprising component A and at least one component selected from components B, C, D and E, as described above, which can be blended with the base gasoline to form a gasoline composition according to the present invention preferably accords with one of parameters (i) to (v) below, or a combination of one of parameters (i) to (v) and one of parameters (vi) to (x):

(i) at most 40% vol.;
(ii) at most 35% vol.;
(iii) at most 30% vol.;
(iv) at most 25% vol.;
(v) at most 20% vol.;

with features (i), (ii), (iii), (iv) and (v) being progressively more preferred; and (vi) at least 0.5% vol.;
(vii) at least 1.0% vol.;
(viii) at least 2.0% vol.;
(ixi) at least 3.0% vol.;
(x) at least 5.0% vol.;

with features (vi), (vii), (viii), (ix) and (x) being progressively more preferred.

The concentration of the composition comprising component A and at least one component selected from components B, C, D and E, is calculated on the basis of a composition comprising component A and at least one component selected from components B, C, D and E, in the absence of the base gasoline, whether or not such a composition is prepared prior to combining components A to E with the base gasoline.

Ranges having a combination of any feature selected from (i) through (v) above and any feature selected from (vi) through (x) above are particularly applicable in the gasoline compositions provided by the present invention. Examples of specific combinations of the above features include (i) and (vi), (ii) and (vii), (iii) and (viii), (iv) and (ix), and (v) and (x), respectively being progressively more preferred.

The base gasoline to which the composition of the present invention can be blended with may be any gasoline suitable for use in an internal combustion engine of the spark-ignition (petrol) type known in the art.

The base gasoline typically comprises mixtures of hydrocarbons boiling in the range from 25 to 230° C. (EN-ISO 3405), the optimal ranges and distillation curves typically varying according to climate and season of the year. The hydrocarbons in a gasoline base fuel may be derived by any means known in the art, conveniently the hydrocarbons may be derived in any known manner from straight-run gasoline, synthetically-produced aromatic hydrocarbon mixtures, thermally or catalytically cracked hydrocarbons, hydro-cracked petroleum fractions, catalytically reformed hydrocarbons or mixtures of these.

The specific distillation curve, hydrocarbon composition, research octane number (RON) and motor octane number (MON) of the gasoline base fuel are not critical.

Conveniently, the research octane number (RON) of the gasoline base fuel may be in the range of from 80 to 110, preferably from 90 to 105, more preferably from 93 to 102, most preferably from 94 to 100 (EN 25164); the motor octane number (MON) of the gasoline base fuel may suitably be in the range of from 70 to 110, preferably from 75 to 105, more preferably from 80 to 100, most preferably from 84 to 95 (EN 25163).

Typically, gasoline base fuels comprise components selected from one or more of the following groups; saturated hydrocarbons, olefinic hydrocarbons, aromatic hydrocarbons, and oxygenated hydrocarbons. Conveniently, the gasoline base fuel may comprise a mixture of saturated hydrocarbons, olefinic hydrocarbons, aromatic hydrocarbons, and, optionally, oxygenated hydrocarbons.

Typically, the olefinic hydrocarbon content of the gasoline base fuel is in the range of from 0 to 40 percent by volume based on the gasoline base fuel; preferably, the olefinic hydrocarbon content of the gasoline base fuel is in the range of from 0 to 30 percent by volume based on the gasoline base fuel.

Typically, the aromatic hydrocarbon content of the gasoline base fuel is in the range of from 0 to 70 percent by volume based on the gasoline base fuel; preferably, the aromatic hydrocarbon content of the gasoline base fuel is in the range of from 10 to 60 percent by volume based on the gasoline base fuel.

The benzene content of the gasoline base fuel is at most 10 percent by volume, more preferably at most 5 percent by volume, especially at most 1 percent by volume based on the gasoline base fuel.

Typically, the saturated hydrocarbon content of the gasoline base fuel is at least 40 percent by volume based on the gasoline base fuel; preferably, the saturated hydrocarbon content of the gasoline base fuel is in the range of from 40 to 80 percent by volume based on the gasoline base fuel.

The gasoline base fuel preferably has a low or ultra low sulphur content, for instance at most 1000 ppmw (parts per million by weight), preferably no more than 500 ppmw, more preferably no more than 100, even more preferably no more than 50 and most preferably no more than even 10 ppmw.

The gasoline base fuel also preferably has a low total lead content, such as at most 0.005 g/l, most preferably being lead free-having no lead compounds added thereto (i.e. unleaded).

When the gasoline comprises oxygenated hydrocarbons, at least a portion of non-oxygenated hydrocarbons will be substituted for oxygenated hydrocarbons.

The oxygenated hydrocarbons that may be included in the gasoline base fuel are oxygenated components other than components A to E described herein. If the base gasoline contains an oxygenated component of the type described by components A to E, then this component is to be considered as a component of the composition according to the present invention and the relative quantities of the other components A to E will be adjusted accordingly.

Examples of suitable gasoline base fuels include gasoline base fuels which have an olefinic hydrocarbon content of from 0 to 20 percent by volume (ASTM D1319), an oxygen content of from 0 to 5 percent by weight (EN 1601), an aromatic hydrocarbon content of from 0 to 50 percent by volume (ASTM D1319) and a benzene content of at most 1 percent by volume.

Whilst not critical to the present invention, the gasoline base fuel or the gasoline composition of the present invention may conveniently additionally include one or more fuel additive. The concentration and nature of the fuel additive(s) that may be included in the gasoline base fuel or the gasoline composition of the present invention is not critical. Non-limiting examples of suitable types of fuel additives that can be included in the gasoline base fuel or the gasoline composition of the present invention include anti-oxidants, corrosion inhibitors, detergents, dehazers, antiknock additives, metal deactivators, valve-seat recession protectant compounds, dyes, friction modifiers, carrier fluids, diluents and markers. Examples of suitable such additives are described generally in U.S. Pat. No. 5,855,629.

Conveniently, the fuel additives can be blended with one or more diluents or carrier fluids, to form an additive concentrate, the additive concentrate can then be admixed with the gasoline composition or gasoline base fuel.

The (active matter) concentration of any additives present in the gasoline base fuel or the gasoline composition is preferably up to 1 percent by weight, more preferably in the range from 5 to 1000 ppmw, advantageously in the range of from 75 to 300 ppmw, such as from 95 to 150 ppmw.

A gasoline composition according to the present invention may be prepared by a process which comprises bringing into admixture with the base gasoline, a composition comprising component A and at least one of components B, C, D and E, and optionally other conventional gasoline components, such as one or more fuel additives. As explained above, it is not critical that the composition comprising component A and at least one of components B, C, D and E is formed prior to blending with the base gasoline, provided that component A and at least one of components B to E are brought into admixture with the base gasoline (i.e. the composition may be formed in-situ).

Therefore, the present invention provides a process for the preparation of a gasoline composition as described above, said process comprising bringing into admixture with the base gasoline, a composition comprising component A and at least one component selected from categories (a) and (b) below:

(a) component B, and (b) one component selected from components C, D and E.

Alternatively, the present invention provides a process for the preparation of a gasoline composition as described above, said process comprising bringing into admixture with the base gasoline, component A and at least one component selected from categories (a) and (b) below:

(a) component B, and (b) one component selected from components C, D and E.

If the gasoline composition additionally comprises one or more fuel additives, then the one or more fuel additive, or the additive concentrate, may be admixed with one or more of the constituents of the gasoline composition (e.g. component A, component B, component C, component D, component E, or the composition comprising component A and at least one component selected from categories (a) and (b) as described above, and the base gasoline) or with the gasoline composition itself. If the one or more fuel additive is added to more than one of the constituents of the gasoline composition, then the fuel additive added to each of the constituents of the gasoline composition may be the same or different.

The present invention also provides a method of operating a spark-ignition internal combustion engine, which comprises bringing into the combustion chambers of said engine a gasoline composition as defined above.

Advantageously, it has also been found that the use of gasoline compositions according to the present invention can also unexpectedly provide benefits in terms of improved lubricity of the gasoline composition compared to the gasoline compositions not containing component A.

The present invention will be further understood from the following examples, which is provided for illustration only and is not to be construed as limiting the claimed invention in any way. Unless otherwise indicated, parts and percentages (concentration) are by volume (% v/v) and temperatures are in degrees Celsius (° C.).

EXAMPLES

Comparative Examples A to C

The base gasoline used in comparative examples A to C was an EN 228 unleaded gasoline having the specific properties detailed in Table 1 below:

TABLE 1

| Property | |
|---|---|
| RON | 95.1 |
| MON | 85.4 |
| RVP (kPa) | 93.4 |
| Density (kg/m$^3$) | 738.5 |
| IBP (° C.) | 27.3 |
| FBP (° C.) | 203.6 |
| Residue (% v) | 1.0 |
| Recovery (% v) | 95.5 |
| Loss (% v) | 3.5 |
| 10% evap (° C.) | 43.6 |
| 20% evap (° C.) | 58.6 |
| 30% evap (° C.) | 75.2 |
| 40% evap (° C.) | 90.5 |
| 50% evap (° C.) | 102.2 |
| 60% evap (° C.) | 111.0 |
| 70% evap (° C.) | 120.2 |
| 80% evap (° C.) | 134.8 |
| 90% evap (° C.) | 159.5 |
| 95% evap (° C.) | 175.6 |
| E70 (% v) | 26.9 |
| E100 (% v) | 47.8 |
| E120 (% v) | 69.7 |
| E150 (% v) | 86.5 |
| E180 (% v) | 95.9 |

The base gasoline described in Table 1 above and blends of the base gasoline with 5% vol. and 10% vol. ethyl pentenoate (EP), based on the volume of the formulated gasoline composition, were prepared.

The ethyl pentenoate used was a mixed isomer ethyl pentenoate component prepared in accordance with the process described in WO 2005/058793 A1. The composition of the mixed isomer ethyl pentenoate component determined by $^{13}$C NMR analysis is detailed in Table 2 below.

TABLE 2

| Component | Mole % | Weight % |
|---|---|---|
| Unreacted gamma valerolactone | 0.0 | 0.0 |
| Unreacted ethanol | 0.0 | 0.0 |
| Diethyl ether | 2.0 | 1.2 |
| Ethyl 2-pentenoate | 6.0 | 6.0 |
| Ethyl 3-pentenoate (trans) | 47.7 | 48.1 |
| Ethyl 3-pentenoate (cis) | 22.6 | 22.7 |
| Ethyl 4-pentenoate | 21.8 | 22.0 |

The properties of each of the gasoline compositions are provided in Table 3 below.

TABLE 3

| Example | Base Gasoline (% v/v) | EP (% v/v) | RVP (kPa) | ΔRVP (%)^ | E70 (% v) | ΔE70 (%)^ | E100 (% v) | ΔE100 (%)^ | E70 + E100 (% v) | ΔE70 + E100 (%)^ |
|---|---|---|---|---|---|---|---|---|---|---|
| A* | 100 | 0 | 93.4 | 0.0 | 26.9 | 0.0 | 47.8 | 0.0 | 74.7 | 0.0 |
| B* | 95 | 5 | 85.7 | −8.2 | 24.3 | −9.7 | 44.1 | −7.7 | 68.4 | −8.4 |
| C* | 90 | 10 | 81.6 | −12.6 | 23.2 | −13.8 | 41.1 | −14.0 | 64.3 | −13.9 |

*Comparative example.

^Relative difference to the base gasoline value expressed as a percentage.

Comparative Examples D to G

The base gasoline used in comparative examples E to H was an EN 228 unleaded gasoline having the specific properties detailed in Table 4 below:

TABLE 4

| Property | |
|---|---|
| RON | 92.2 |
| MON | 83.0 |
| Density (kg/m$^3$) | 740.9 |
| IBP (° C.) | 35.3 |
| FBP (° C.) | 193.4 |
| Recovery (% v) | 97.5 |
| 10% evap (° C.) | 52.4 |
| 20% evap (° C.) | 58.6 |
| 30% evap (° C.) | 65.2 |
| 40% evap (° C.) | 73.1 |
| 50% evap (° C.) | 83.9 |
| 60% evap (° C.) | 97.1 |
| 70% evap (° C.) | 113.8 |
| 80% evap (° C.) | 132 |
| 90% evap (° C.) | 151.6 |
| 95% evap (° C.) | 164.7 |
| E70 (% v) | 36.2 |
| E100 (% v) | 61.8 |
| E120 (% v) | 73.4 |
| E150 (% v) | 89.4 |
| E180 (% v) | 97.7 |

The base gasoline described in Table 4 above and blends of the base gasoline with 5% vol., 10% vol. and 20% vol. ethanol (EtOH), based on the volume of the formulated gasoline composition, were prepared.

The ethanol (anhydrous) used was supplied by Sigma-Aldrich and had a purity of >99%.

The properties of each of the gasoline compositions are provided in Table 5 below.

TABLE 5

| Example | Base Gasoline (% v/v) | EtOH (% v/v) | E70 (% v) | ΔE70 (%)^ | E100 (% v) | ΔE100 (%)^ | E70 + E100 (% v) | ΔE70 + E100 (%)^ |
|---|---|---|---|---|---|---|---|---|
| D* | 100 | 0 | 36.2 | 0.0 | 61.8 | 0.0 | 98.0 | 0.0 |
| E* | 95 | 5 | 44.7 | 23.5 | 65.2 | 5.5 | 109.9 | 12.1 |
| F* | 90 | 10 | 55.2 | 52.5 | 66.0 | 6.8 | 121.2 | 23.7 |
| G* | 80 | 20 | 55.8 | 54.1 | 74.8 | 21.0 | 149.6 | 33.3 |

*Comparative example.

^Relative difference to the base gasoline value expressed as a percentage.

Comparative Example H and Examples 1 to 16

The properties of several gasoline compositions containing compositions according to the present invention are given below.

The base gasoline used in the following examples was an EN 228 unleaded gasoline having the specific properties detailed in Table 6 below.

TABLE 6

| Property | |
|---|---|
| RON | 95.5 |
| MON | 85.0 |
| RVP (kPa) | 89.1 |
| Density (kg/m$^3$) | 730.8 |
| IBP (° C.) | 25.7 |
| FBP (° C.) | 198.9 |

TABLE 6-continued

| Property | |
|---|---|
| Residue (% v) | 0.8 |
| Recovery (% v) | 97.1 |
| Loss (% v) | 2.1 |
| 10% evap (° C.) | 39.9 |
| 20% evap (° C.) | 50.8 |
| 30% evap (° C.) | 63.2 |
| 40% evap (° C.) | 77 |
| 50% evap (° C.) | 91.2 |
| 60% evap (° C.) | 104.6 |
| 70% evap (° C.) | 116. |
| 80% evap (° C.) | 131.8 |
| 90% evap (° C.) | 155.1 |
| 95% evap (° C.) | 170.7 |
| E70 (% v) | 35.1 |
| E100 (% v) | 56.3 |
| E120 (% v) | 72.4 |
| E150 (% v) | 88.1 |
| E180 (% v) | 96.8 |

The ethyl pentenoate used was ethyl 4-pentenoate (ex Bedoukian Chemicals).

The ethanol (anhydrous) used was supplied by Sigma-Aldrich and had a purity of >99%.

The 2-methyl furan used was supplied by Sigma-Aldrich and had a purity of 99%.

To prepare the gasoline compositions, four separate compositions according to the present invention were prepared and are detailed in Table 7 below.

TABLE 7

| Example | Composition | Ethyl Pentenoate (% v/v) | Ethanol (% v/v) | 2-Methyl Furan (% v/v) |
|---|---|---|---|---|
| 1 | Ox1 | 48 | 0 | 52 |
| 2 | Ox2 | 58 | 10 | 32 |
| 3 | Ox3 | 69 | 20 | 11 |
| 4 | Ox4 | 74 | 26 | 0 |

Using the above four oxygenate compositions (Ox1 to Ox4), twelve different gasoline compositions were prepared by admixing each of the above oxygenate compositions (Ox1, Ox2, Ox3 and Ox4) individually with the base gasoline detailed in Table 6, at 5% vol., 10% vol. and 20% vol. concentrations based on the volume of the formulated gasoline composition.

The properties of each of the gasoline compositions are provided in Table 8 below.

TABLE 8

| Example | Base Gasoline (% v/v) | Oxygenate (% v/v) Ox1 | Ox2 | Ox3 | Ox4 | RVP (kPa) | ΔRVP (%)^ | E70 (% v) | ΔE70 (%)^ | E100 (% v) | ΔE100 (%)^ | E70 + E100 (% v) | ΔE70 + E100 (%)^ |
|---|---|---|---|---|---|---|---|---|---|---|---|---|---|
| H* | 100 | | | | | 89.1 | 0.0 | 35.1 | 0.0 | 56.3 | 0.0 | 91.4 | 0.0 |
| 5 | 95 | 5 | | | | 86.6 | −2.8 | 34.4 | −2.0 | 56.4 | +0.2 | 90.8 | −0.7 |
| 6 | 95 | | 5 | | | 89.0 | −0.1 | 34.3 | −2.3 | 55.3 | −1.8 | 89.6 | −2.0 |
| 7 | 95 | | | 5 | | 90.4 | +1.5 | 34.3 | −2.3 | 54.5 | −3.2 | 88.8 | −2.8 |
| 8 | 95 | | | | 5 | 90.1 | +1.1 | 32.7 | −6.8 | 52.9 | −6.0 | 85.6 | −6.3 |
| 9 | 90 | 10 | | | | 84.0 | −5.7 | 32.8 | −6.6 | 55.8 | −0.9 | 88.6 | −3.1 |
| 10 | 90 | | 10 | | | 87.5 | −1.8 | 34.1 | −2.8 | 54.9 | −2.5 | 89.0 | −2.6 |
| 11 | 90 | | | 10 | | 88.8 | −0.3 | 32.7 | −6.8 | 52.0 | −7.6 | 84.7 | −7.3 |
| 12 | 90 | | | | 10 | 90.0 | +1.0 | 34.7 | −1.1 | 52.1 | −7.5 | 86.8 | −5.0 |
| 13 | 80 | 20 | | | | 80.5 | −9.7 | 31.7 | −9.7 | 56.0 | −0.5 | 87.7 | −4.0 |
| 14 | 80 | | 20 | | | 83.6 | −6.2 | 33.9 | −3.4 | 53.7 | −4.6 | 87.6 | −4.2 |
| 15 | 80 | | | 20 | | 84.8 | −4.8 | 35.0 | −0.3 | 50.4 | −10.5 | 85.4 | −6.6 |
| 16 | 80 | | | | 20 | 84.7 | −4.9 | 36.5 | 4.0 | 49.4 | −12.3 | 85.9 | −6.0 |

*Comparative example.

^Relative difference to the base gasoline value expressed as a percentage.

It can clearly be seen that the E70, E100 and the E70+E100 values of the gasoline compositions according to the present invention are not significantly altered from the E70, E100 and the E70+E100 values of the base gasoline (Comparative Example H). In particular, the impact on the E70, E100 and the E70+E100 values of the base gasoline is reduced compared to when only ethanol or only ethyl pentenoate are blended with a base gasoline (comparative examples A to G). Additionally, it can clearly be seen that the E70 and E100 values of the gasoline compositions according to the present invention are well within the current EN 228 gasoline specifications.

It can additionally be seen that the RVP values of the gasoline compositions according to the present invention were not significantly altered from the RVP value of the base gasoline composition. In most examples, the RVP of the gasoline compositions according to the present invention resulted in a slight decrease of the RVP value relative to the RVP value of the base gasoline, and when the RVP of the gasoline was higher than the RVP of the base gasoline, this increase in RVP was a change of less than 2 percent relative to the base gasoline.

Examples 17 & 18

Examples Utilising Equation I $$E100_{base+Ox}=(1-x_n)E100_{base}+x_nE100_{Ox} \quad [1]$$

where:

$E100_{base+Ox}$ is the E100 of a mixture of base gasoline and oxygenates $E100_{base}$ is the E100 of the base fuel $E100_{Ox}$ is the E100 of the oxygenates mixture $x_n$ is the volume fraction of the oxygenate(s) in the base gasoline and oxygenates mixture E100 is the percentage evaporated at a temperature of 100° C.

$$E100_{Ox} = \sum_{n=1}^{n=3} v_{fn}E100_n \quad [2]$$

where:

Ox is a mixture of oxygenate A and at least one component selected from categories (a) and (b) where (a) is component B and (b) is one component selected from C, D and E n=1 is component B n=2 is component A n=3 is any of components C, D or E $v_{fn}$ is the volume fractions of n=1, 2 and 3

$E100_n$ is the blending E100 value of component n and the sum of the volume fraction of the oxygenates is equal to one:

$$\sum_{n=1}^{n=3} v_{fn} = 1 \quad [3]$$

The change in E100 (ΔE100) when an oxygenate(s) mixture is added to a base gasoline is:

$$\Delta E100=E100_{base+Ox}-E100_{base} \quad [4]$$

$$E70_{base+Ox}=(1-x_n)E70_{base}+x_nE70_{Ox} \quad [5]$$

where:

$E70_{base+Ox}$ is the E70 of a mixture of base gasoline and oxygenates $E70_{base}$ is the E70 of the base fuel $E70_{Ox}$ is the E70 of the oxygenates mixture $x_n$ is the volume fraction of the oxygenates in the base gasoline and oxygenates mixture E70 is the percentage evaporated at a temperature of 70° C.

$$E70_{Ox} = \sum_{n=1}^{n=3} v_{fn}E70_n \quad [6]$$

where:

Ox is a mixture of oxygenate A and at least one component selected from categories (a) and (b) where (a) is component B and (b) is one component selected from C, D and E n=1 is component B n=2 is component A n=3 is any of components C, D or E $v_{fn}$ is the volume fractions of n=1, 2 and 3

$E70_n$ is the blending E70 value of component n

The change in E70 (ΔE70) when an oxygenates mixture is added to a base gasoline is:

$$\Delta E70 = E70_{base+Ox} - E70_{base} \quad [7]$$

The desired outcome for the mixture of base gasoline and oxygenates is that:

$$\Delta E70 + \Delta E100 = 0 \quad [8]$$

Substitution of equations 7 and 4 into equation 8 with rearrangement gives:

$$E70_{Ox} - E70_{base} = E100_{base} - E100_{Ox} \quad [9]$$

or $$\sum_{n=1}^{n=3} v_{fn} E70_n - E70_{base} = E100_{base} - \sum_{n=1}^{n=3} v_{fn} E100_n \quad \text{(equation I)}$$

Consequently for a given base fuel, values of $v_{f1}$, $v_{f2}$ and $v_{f3}$ can be defined which satisfy the requirement of equation I and therefore result in ΔE70+ΔE100=0—that is control over the change in a base gasoline's distillation profile when a mixture of oxygenates is added.

For two gasoline formulations, one a lower volatility gasoline (Example 17) and one a higher volatility gasoline (Example 18), a blend ratio of ethanol (n=1; component B) of 10 vol % is to be used for the oxygenates composition. For each base gasoline the E70 and the E100 is obtained, as per EN ISO 3405. Ethyl pentenoate (n=2; component A) and 2-methyl furan (n=3, component C) are additionally to be used in the oxygenates composition. For each of the oxygenates used, the blending E70 and E100 values are determined. Volume fractions for the ethyl pentenoate and the 2-methyl furan components of the oxygenates composition are then determined to satisfy equation I:

Example 17

$E70_{base}$=20% v, $E100_{base}$=50% v

| | | | | | |
|---|---|---|---|---|---|
| $E70_1$ | (% v) | 235 | $E100_1$ | (% v) | 110 |
| $E70_2$ | (% v) | −18 | $E100_2$ | (% v) | −23 |
| $E70_3$ | (% v) | 44 | $E100_3$ | (% v) | 125 |
| $E70_{base}$ | (% v) | 20 | $E100_{base}$ | (% v) | 50 |
| $V_{f1}$ | | 0.100 | $V_{f1}$ | | 0.100 |
| $V_{f2}$ | | 0.558 | $V_{f2}$ | | 0.558 |
| $V_{f3}$ | | 0.342 | $V_{f3}$ | | 0.342 |
| $\sum_{n=1}^{n=3} v_{fn} E70_n - E70_{base}$ | (% v) | 8.8 | $E100_{base} - \sum_{n=1}^{n=3} v_{fn} E100_n$ | (% v) | 8.8 |
| $E70_{base+Ox}$ when $x_n$ = 5% v | (% v) | 20 | $E100_{base+Ox}$ when $x_n$ = 5% v | (% v) | 50 |
| $E70_{base+Ox}$ when $x_n$ = 10% v | (% v) | 21 | $E100_{base+Ox}$ when $x_n$ = 10% v | (% v) | 49 |
| $E70_{base+Ox}$ when $x_n$ = 20% v | (% v) | 22 | $E100_{base+Ox}$ when $x_n$ = 20% v | (% v) | 48 |

Example 18

$E70_{base}$=45% v, $E100_{base}$=70% v

| | | | | | |
|---|---|---|---|---|---|
| $E70_1$ | (% v) | 235 | $E100_1$ | (% v) | 110 |
| $E70_2$ | (% v) | −18 | $E100_2$ | (% v) | −23 |
| $E70_3$ | (% v) | 44 | $E100_3$ | (% v) | 125 |
| $E70_{base}$ | (% v) | 45 | $E100_{base}$ | (% v) | 70 |
| $V_{f1}$ | (% v) | 0.100 | $V_{f1}$ | | 0.100 |
| $V_{f2}$ | (% v) | 0.343 | $V_{f2}$ | | 0.343 |
| $V_{f3}$ | (% v) | 0.557 | $V_{f3}$ | | 0.557 |
| $\sum_{n=1}^{n=3} v_{fn} E70_n - E70_{base}$ | | −2.9 | $E100_{base} - \sum_{n=1}^{n=3} v_{fn} E100_n$ | (% v) | −2.9 |
| $E70_{base+Ox}$ when $x_n$ + 5% v | (% v) | 45 | $E100_{base+Ox}$ when $x_n$ + 5% v | (% v) | 70 |
| $E70_{base+Ox}$ when $x_n$ + 10% v | (% v) | 45 | $E100_{base+Ox}$ when $x_n$ + 10% v | (% v) | 70 |
| $E70_{base+Ox}$ when $x_n$ + 20% v | (% v) | 44 | $E100_{base+Ox}$ when $x_n$ + 20% v | (% v) | 71 |

We claim:

1. A gasoline composition comprising (i) a base gasoline having an $E70_{base}$ value and an $E100_{base}$ value; and (ii) an oxygenate composition comprising component A and at least one component selected from components B, C, D and E, wherein:

component A is an alkyl alkenoate compound, or a mixture of alkyl alkenoate compounds, selected from compounds of formula I:

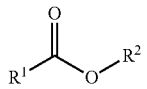

(I)

wherein $R^1$ is a linear alkenyl group containing 3 to 5 carbon atoms, optionally substituted by a methyl group, and $R^2$ is a linear or branched alkyl group containing 1 to 6 carbon atoms, with the proviso that component A has a boiling point or boiling point range within the temperature range of from 90 to 200° C.;

component B is ethanol;

component C is a compound of formula II or formula III:

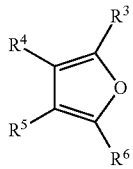

(II)

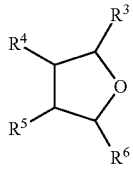

(III)

wherein the $R^3$, $R^4$, $R^5$ and $R^6$ groups are independently selected from hydrogen and $C_{1-6}$ hydrocarbyl groups, with the proviso that component C has a boiling point or boiling point range of at most 110° C.;

component D is butanol; and component E is an ether of the general formula IV:

$$R^7—O—C(Me)_3 \quad (IV)$$

wherein $R^7$ is selected from methyl, ethyl or mixtures thereof;

wherein the gasoline composition has an E70 value and an E100 value;

wherein the oxygenate composition maintains the E70 value and E100 value of the gasoline composition within 25% of the $E70_{base}$ value and the $E100_{base}$ value, respectively.

2. The gasoline composition of claim 1 wherein in component A, the $R^1$ group is a linear or branched alkenyl group containing 3 or 4 carbon atoms, and the $R^2$ group is a linear or branched alkyl group containing 2 to 4 carbon atoms.

3. The gasoline composition of claim 1 wherein component A is ethyl pentenoate.

4. The gasoline composition of claim 3 wherein component A is a mixture of isomers of ethyl pentenoate.

5. The gasoline composition of claim 1 wherein at least component C is selected and in component C, the $R^4$ and $R^5$ groups are hydrogen, the $R^3$ and $R^6$ groups are independently selected from hydrogen and $C_{1-6}$ hydrocarbyl groups, with at least one of the $R^3$ and $R^6$ groups being a $C_{1-6}$ hydrocarbyl group, and with the proviso that component C has a boiling point or boiling point range of at most 100° C.

6. The gasoline composition of claim 5 wherein component C is selected from 2-methyl furan, 2,5-dimethyl furan and mixtures thereof.

7. The gasoline composition of claim 1 wherein said oxygenate composition comprises component A and at least one component selected from each categories (a) and (b) below:

(a) component B, and (b) one component selected from components C, D and E.

8. The gasoline composition of claim 1 wherein the base gasoline is unleaded.

9. The gasoline composition of claim 8, wherein the concentration of the oxygenate composition is in the range of from 0.5 to 40% vol., based on the gasoline composition.

10. The gasoline composition of claim 1, wherein the oxygenate composition maintains the E70 value and E100 value of the gasoline composition within 20% of the $E70_{base}$ value and the $E100_{base}$ value, respectively.

11. The gasoline composition of claim 10, wherein the oxygenate composition maintains the E70 value and E100 value of the gasoline composition within 15% of the $E70_{base}$ value and the $E100_{base}$ value, respectively.

12. The gasoline composition of claim 1 wherein the oxygenate composition maintains the sum of E70 and E100 values within 15% of the sum of $E70_{base}$ and $E100_{base}$ values.

13. The gasoline composition of claim 12 wherein the oxygenate composition maintains the sum of E70 and E100 values within 10% of the sum of $E70_{base}$ and $E100_{base}$ values.

14. The gasoline composition of claim 13 wherein the oxygenate composition maintains the sum of E70 and E100 values within 5% of the sum of $E70_{base}$ and $E100_{base}$ values.

15. The gasoline composition of claim 1 wherein at least component B is selected, and the concentration of component A is at least 50% vol. and the concentration of component B is at most 50% vol., based on the oxygenate composition.

16. The gasoline composition of claim 1 wherein at least component C is selected, and the concentration of component A is at most 70% vol. and the concentration of component C is at least 30% vol., based on the oxygenate composition.

17. The gasoline composition of claim 1 wherein at least component D is selected, and the concentration of component A is at most 50% vol. and the concentration of component D is at least 50% vol., based on the oxygenate composition.

18. The gasoline composition of claim 1 wherein at least component E is selected, and the concentration of component A is at most 50% vol. and the concentration of component E is at least 50% vol., based on the oxygenate composition.

19. The gasoline composition of claim 1 wherein at least components B and C are selected, and the concentration of component A is at least 23% vol., the concentration of component B is at least 0.1% vol., and the concentration of component C is at least 0.1% vol., based on the oxygenate composition.

20. The gasoline composition of claim 1 wherein at least components B and D are selected, and the concentration of component A is at least 0.1% vol., the concentration of component B is at least 0.1% vol., and the concentration of component D is at least 0.1% vol., based on the oxygenate composition.

21. The gasoline composition of claim 1 wherein at least components B and E are selected, and the concentration of component A is at least 10% vol., the concentration of component B is at least 0.1% vol., and the concentration of component C is at least 0.1% vol., based on the oxygenate composition.

22. The gasoline composition of claim 1 wherein the oxygenate composition comprises component A and at least two components selected from components B, C, D, and E.

* * * * *